United States Patent [19]

Waldrum

[11] Patent Number: 5,031,839

[45] Date of Patent: Jul. 16, 1991

[54] VOLUME CONTROLLABLE APPLICATOR

[75] Inventor: John E. Waldrum, Ambler, Pa.

[73] Assignee: DowElanco, Indianapolis, Ind.

[21] Appl. No.: 406,972

[22] Filed: Sep. 13, 1989

[51] Int. Cl.[5] ..... B05B 9/04

[52] U.S. Cl. ..... 239/331; 239/321; 239/525; 222/324

[58] Field of Search ..... 239/320, 321, 322, 329, 239/331, 526, 525; 222/379, 380, 321, 324, 309

[56] References Cited

U.S. PATENT DOCUMENTS

| | | | |
|---|---|---|---|
| 1,999,655 | 4/1935 | Coyle | 239/331 |
| 2,557,247 | 6/1951 | Ziherl | 222/324 |
| 2,567,496 | 9/1951 | Pittenger | 222/321 |
| 2,741,511 | 4/1956 | Rollins | 239/331 |
| 2,980,343 | 4/1961 | Hays | 239/331 |
| 3,156,385 | 11/1964 | Yetter | 239/322 |
| 3,653,556 | 4/1972 | Moran et al. | 222/309 |
| 4,784,293 | 11/1988 | Hiroshi | 222/380 |

FOREIGN PATENT DOCUMENTS

| | | | |
|---|---|---|---|
| 231578 | 11/1960 | Australia | 239/331 |
| 473248 | 9/1914 | France | 239/331 |
| 768249 | 2/1957 | United Kingdom | 239/321 |

*Primary Examiner*—Andres Kashnikow
*Assistant Examiner*—Christopher G. Trainor
*Attorney, Agent, or Firm*—Eckert, Seamans, Cherin & Mellott

[57] ABSTRACT

A volume controllable applicator is disclosed in the form of a self-contained spot gun for the application of pesticides and the like. The applicator includes an elongate applicator tube where terminates forwardly in a spray nozzle and rearwardly in a connection to a piston within a cylinder. A housing overfits a rearward portion of the applicator tube and the applicator tube is reciprocal relative to the housing by employing a pivotal, operating handle. An adjustable stop is affixed to the applicator tube forwardly of the housing to precisely limit and control the length of movement of the applicator tube relative to the housing in a manner to precisely control the volume of the effluent as it is pumped by the piston. A first one-way valve is connected to the cylinder inlet to admit the liquid chemical into the cylinder upon movement of the operating handle toward its suction position. A second one-way valve is secured within the piston to permit liquid flow through the interior of the piston upon movement of the operating handle toward its applicating position.

20 Claims, 3 Drawing Sheets

VOLUME CONTROLLABLE APPLICATOR

BACKGROUND OF THE INVENTION

1. Field of the Invention

The present invention relates generally to the field of agricultural chemical applicators, and more particularly, is directed to a hand-held spot applicator including means to precisely adjust the flow rate of application.

2. Discussion of the Prior Art

Mechanisms to aid in the application of liquid agricultural chemicals to gardens, fields and other surface areas have long been a popular subject matter for prior workers in the art. Numerous types of mechanical applicators and sprayers have been developed to spread agricultural chemical products such as fertilizers, insecticides, pesticides, herbicides and the like and these prior art devices have been both manually and mechanically operated. More recently, the apparatus and equipment designed for vehicular transport has tended to become quite complicated in nature and expensive in manufacture and operation. Such types of spray apparatus have been designed for direct attachment to various types of vehicles including both ground vehicles and aircraft and such prior art equipment has generally proven to be effective in substantially uniformly applying the desired chemicals.

Agricultural chemical application equipment has also been particularly designed for manual use by an individual and it is in this particular area that the present invention finds special utility. In U.S. Pat. No. 3,648,935 by the inventor of the present application, a spray apparatus with a rotary movable head has been disclosed. In this apparatus, a movable rotary spray head is rotatively powered through associated apparatus including ground contacting wheels so that as the device is moved over the ground surface, the wheels generate rotary forces sufficient to rotate the rotary spray head. In other applications, the rotary spray head has been removed from the ground contacting wheels and has instead been equipped with a small electric motor for rotatively powering the spray head. By equipping the small motor with a suitable battery, a worker equipped with a suitable liquid storage tank can walk over the ground surface to be sprayed and the electric motor will provide the rotary energy necessary to turn the spray head for agricultural chemical application purposes.

In U.S. Pat. No. 2,162,057, a knapsack type of spraying apparatus has been disclosed wherein a worker can carry the liquid materials to be sprayed in a tank carried on his back. A hose interconnects the liquid contents stored within the tank with a rigid tube and nozzle through a control valve whereby the operator can apply the liquids directly upon the areas to be sprayed as he walks.

While the prior art applicators which are known to the applicant have generally been effective in applying the agricultural liquid chemicals directly upon selected target areas, so far as is known, the prior art devices require an integral pump or require that the tank be pressurized in order to generate sufficient forces for spray application purposes. Further the prior devices are rather randomly controlled and there is no known means to effectively apply a precisely controlled quantity of chemical product directly upon the target area. Under the circumstances, in view of the lack of precision capability of the presently available equipment, it has been found that some areas will receive more than the desired chemical treatment while others will receive less. Thus, the need remains to provide a readily controllable applicator that is capable of applying precise quantities of liquid chemicals in a continuous and reliable manner.

SUMMARY OF THE INVENTION

The present invention relates generally to a volume controllable liquid chemical applicator, and more particularly, is directed to a self-contained, liquid applicator including easily adjustable means to precisely control the volume of the effluent upon each application.

The volume controllable applicator of the present invention is preferably adaptable for use as a spot gun for applying pesticides and the like and comprises generally a hollow housing, an elongate applicator tube that is reciprocal to the housing, an integral piston type pump secured to the housing, an operating handle pivotally secured to the housing and means to vary the pump stroke to precisely control the volume of effluent from the applicator upon each function of the pump.

A conveniently positioned, pivotal, operating handle reciprocates a piston within the pump cylinder to force the pesticide or other agricultural chemical through the applicator tube for direct application upon a target area. An easily adjustable collar secures to the applicator tube forwardly of the handle in a manner to limit the stroke of the piston to precisely control the effluent from the applicator upon each operation of the integral pump.

The integral pump of the volume controllable applicator comprises a reciprocal piston and a cylinder having a liquid inlet controlled by a first, automatic one-way valve. The piston is similarly provided with a second automatic, outlet one-way valve. The parts are so arranged and designed that when the piston is forwardly reciprocated in its suction stroke, the first cylinder inlet valve will automatically open and the second, piston outlet valve will close, to fill the cylinder with the agricultural liquid being sprayed. Upon rearward reciprocation of the piston in its power stroke, the second, outlet one-way valve will open and the first, cylinder inlet valve will close, thereby forcing the liquid contents of the cylinder through the applicator tube, and through the applicator nozzle for direct application upon the selected target area.

A volume control stop is positioned forwardly of the applicator housing and is threadedly engaged therein in a secure interconnection. The volume control stop receives a portion of the applicator tube therethrough in a reciprocating engagement. An adjustment collar is slidable along the applicator tube forwardly of the volume control stop and is provided to readily vary the stroke of the piston to consequently precisely control the amount of liquid chemical delivered through the spray nozzle upon each reciprocation of the pump piston. By adjusting the position of the collar upon the applicator tube relative to the forward end of the volume control stop, any desired flow volume can be achieved within the capability of the applicator. Preferably, an application range of between 1 cc per reciprocation to 8 cc per reciprocation has been found satisfactory for most applications. Of course, the application volume can be increased or decreased if so desired simply by constructing the pump cylinder to either an increased or decreased volumetric capacity whereby a greater or lessor discharge can be achieved upon each reciprocation of the piston.

It is therefore an object of the present invention to provide an improved volume controllable chemical liquid applicator of the type set forth.

It is another object of the present invention to provide a novel volume controllable applicator that incorporates in a unitary device a chemical liquid piston pump means, a spring biased handle means to manually reciprocate a piston within the pump means for liquid application purposes, an applicator tube means including a spray nozzle to direct the effluent from the pump means directly upon the target area and means to vary the stroke of the piston within the pump means to precisely control the quantity of flow upon each reciprocation of the piston.

It is another object of the present invention to provide a novel volume controllable applicator comprising a hollow housing, applicator tube means reciprocal within the housing to direct the liquid upon the target area, pump means connected to the applicator tube means to feed liquid chemical to the applicator tube means, operating handle means connected intermediate the housing and the applicator tube means to reciprocate a piston within the pump for delivery of the liquid to be applied through the applicator tube and means to vary the stroke of the piston to provide more or less liquid flow upon each reciprocation of the piston.

It is another object of the present invention to provide a novel volume controllable applicator comprising in combination piston pump means including a cylinder, a piston reciprocal within the cylinder, a first one-way valve to permit entrance of liquid chemical into the cylinder and a second one-way valve to direct the liquid chemical out of the cylinder, applicator tube means receiving the effluent from the cylinder through the second one-way valve, a housing receiving the applicator tube means therethrough, spring biased operating handle means interconnected between the housing and the applicator tube means to manually reciprocate the piston within the cylinder, and volume control means adjustably secured upon the applicator tube means to control the length of stroke of the piston upon each function of the operating handle means.

It is another object of the present invention to provide a novel volume controllable applicator that is simple in design, inexpensive in construction and trouble-free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
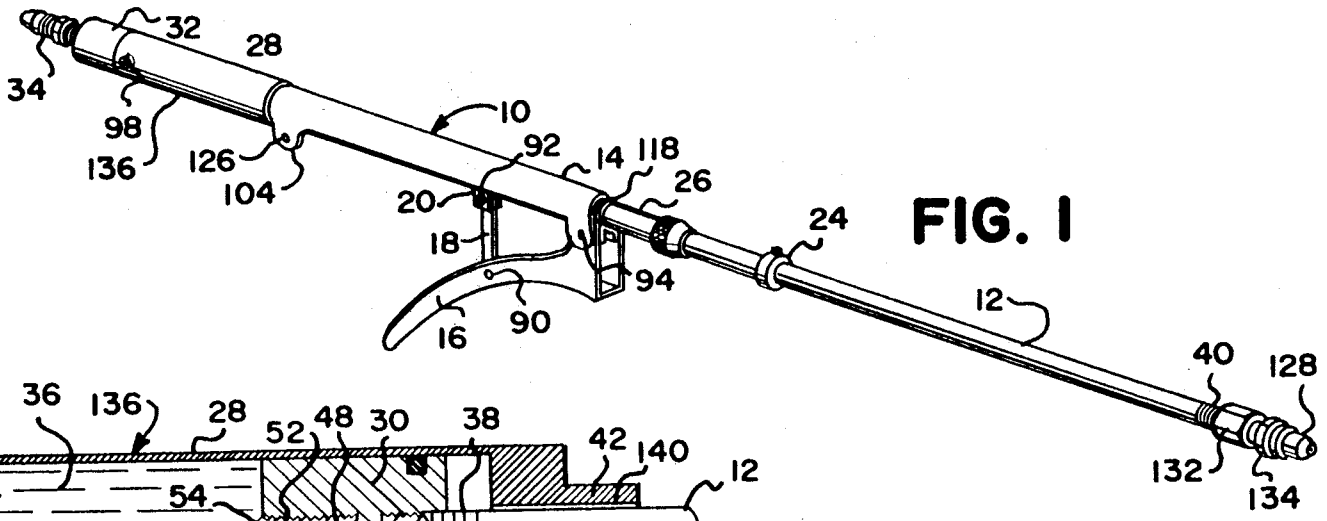
FIG. 1 is a perspective view showing the volume controllable applicator of the present invention.

Although specific terms are used in the following description for the sake of clarity, these terms are intended to refer only to the particular structure of the invention selected for illustration in the drawings, and are not intended to define or limit the scope of the invention.

Referring now to the drawings, there is illustrated in FIG. 1 a volume controllable applicator in the nature of a spot gun 10 suitable to apply an agricultural liquid, for example a pesticide, directly upon a plant or other target area. The spot gun 10 comprises generally an elongate applicator tube 12, the applicator tube terminating at its forward end in a conventional nozzle 128 and at its rearward end in a piston type pump 136. A bent or tubular metal housing 14 extends forwardly from the pump 136 and forwardly supports an adjustable, volume control stop 26 for volume flow control purposes. An operating handle 16 pivotally connects a portion, for example, to the front end of the housing 14 and is spring biased to continuously urge the applicator tube 12 relative to the housing 14 toward an initial position.

Figure 2:
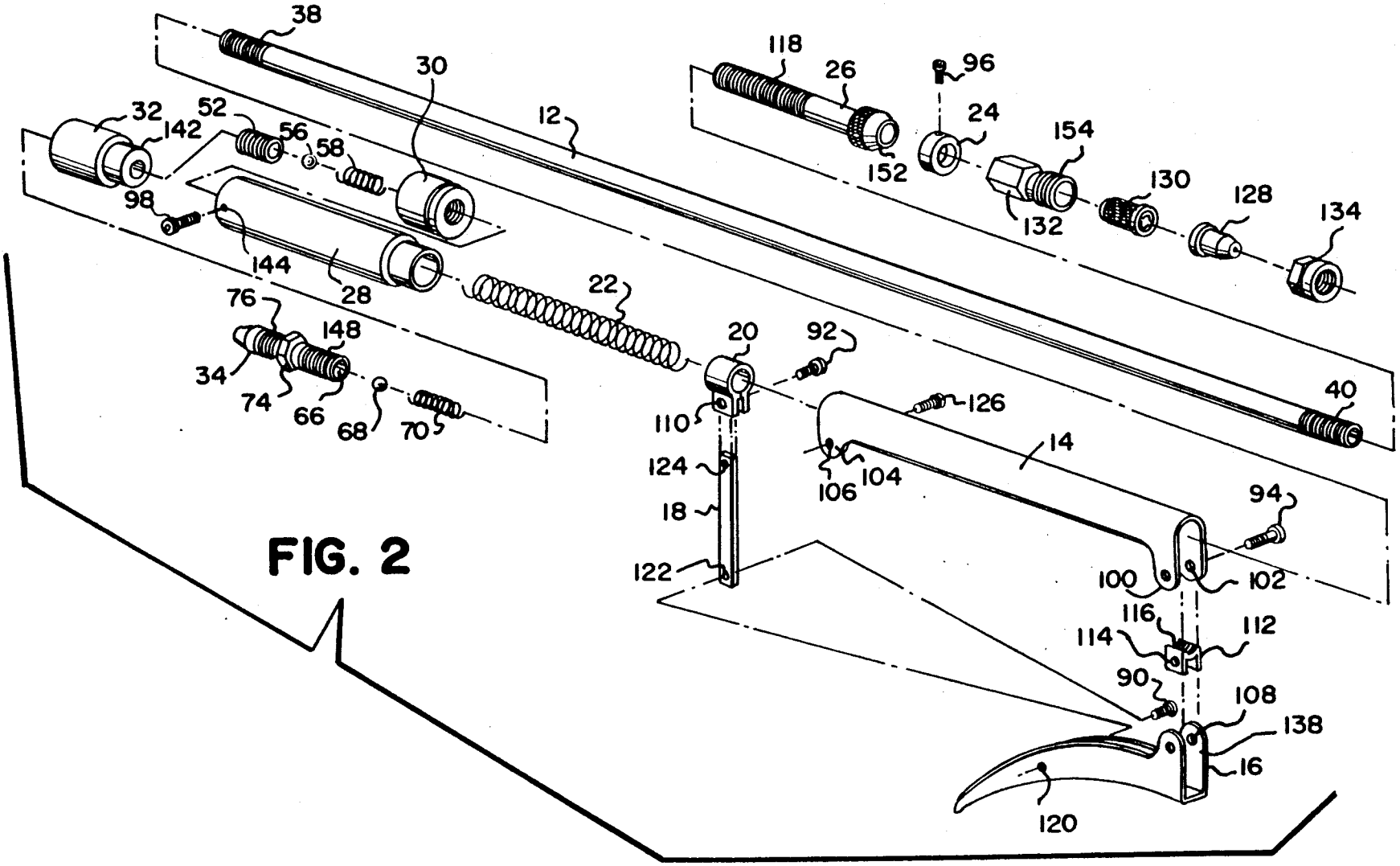
FIG. 2 is an enlarged, exploded, perspective view of the volume controllable applicator.

As best seen in FIGS. 1 and 2, the housing 14 preferably is formed of sheet metal of suitable gage or strength for the purpose. The housing 14 may be stamped or otherwise worked to a generally U-shaped cross sectional configuration of configuration to loosely receive the rearward portion of the applicator tube 12 therewithin. The housing 14 terminates forwardly in a pair of spaced, depending tabs or ears 100, which tabs are provided with aligned openings 102 to receive a pivot pin or bolt 94 therethrough when the parts are assembled. The operating handle 16 may similarly preferably be fabricated of bent sheet steel or otherwise to form a handle portion having cooperating, spaced, upper extending tabs or ears 138. The ears 138 are similarly drilled or otherwise machined to provide aligned pivot openings 108 to receive the pivot bolt 94 therethrough. As shown, the operating handle ears 138 preferably are positioned interiorly of the depending ears 100 at the forward end of the housing 14 to minimize the required width of the operating handle 16.

As best seen in FIG. 2, a channel-shaped retainer 112 is provided at the housing front end assembly and comprises generally an arcuately shaped web and a pair of downwardly depending legs. The legs of the retainer 112 are similarly drilled or otherwise worked to provide aligned openings 114 to receive the pivot bolt 94 therethrough. As illustrated, the arcuate web of the retainer 112 is punched or otherwise worked to form a threaded surface to receive therein in threaded engagement the exterior threads 118 of the volume control stop 26. Accordingly, upon assembly of the parts, as shown in FIGS. 3 and 4, the volume control stop 26 can be threadedly engaged at the forward end of the housing 14 for pump stroke length adjustment purposes as hereinafter more fully set forth.

Figure 4:
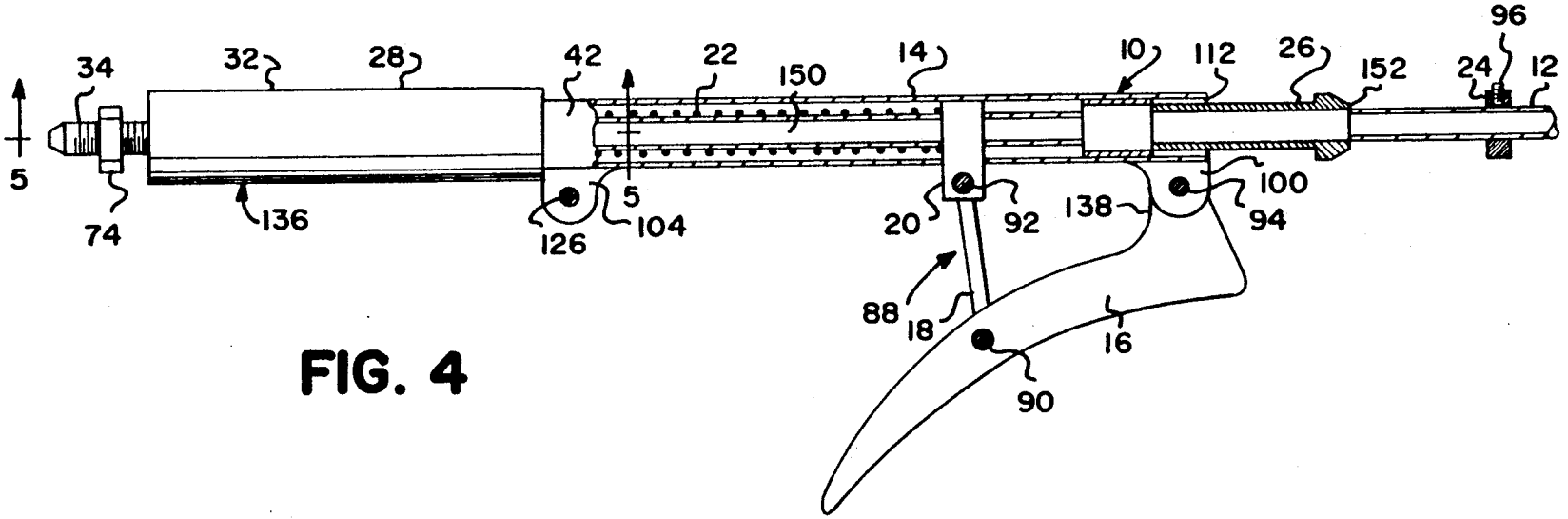
FIG. 4 is a side elevational view similar to FIG. 3, showing the operating handle in its suction position.
Figure 3:
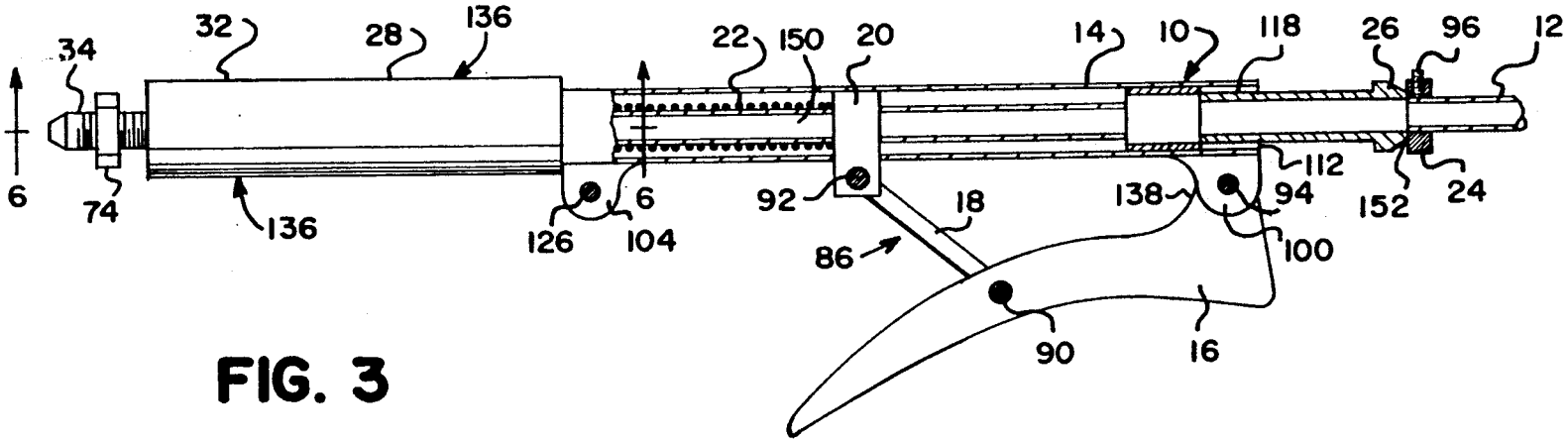
FIG. 3 is a side elevational view of the volume controllable applicator, partially broken away to expose interior construction details, and showing the operating handle in its applicating position.

Still referring to FIGS. 1 and 2, and further considering FIGS. 3 and 4, the operating handle 16 is drilled or otherwise pierced to provide rearward boreholes 120.

The rearward boreholes are suitably spaced from the pivot pin 94 to provide the required mechanical advantage when the applicator or spot gun 10 is in use. One end of an operating link 18 is drilled or otherwise worked to provide a transverse borehole 122 whereby a pivot pin 90 can be readily inserted through the aligned openings 120, 122 to provide a pivotal interconnection between the link 18 and the operating handle 16. The opposite end of the operating link 18 is similarly provided with an upper pivot borehole 124 whereby the opposite end of the link can be pivotally interconnected with the operating collar 20 by employing a conventional pivot bolt 92.

As shown, the operating collar 20 is designed and configured to clamp to and to encircle a rearward portion of the outer periphery of the applicator tube 12 and to easily slide within the hollow interior defined by the bent housing 14. Accordingly, by squeezing the operating handle 16 toward the housing 14, the operating link 18 and the pivotal connectors 90, 92 function to drive the operating collar 20 and the physically attached applicator tube 12 toward the piston pump cylinder 28. An operating spring 22 overfits a rearward portion of the applicator tube 12 and biases between the forward end of the piston pump 136 and the operating collar 20 to continuously bias the operating handle 16 toward its suction position 88 as illustrated in FIG. 4. Upon squeezing the operating handle 16 toward the housing 14, the link 18, the pivot pins 90, 92 and the operating collar 20 cooperatively function to drive the applicator tube 12 rearwardly by overcoming the bias of the spring 22 as the handle moves toward its applicating position 86 as illustrated in FIG. 3.

Figure 5:
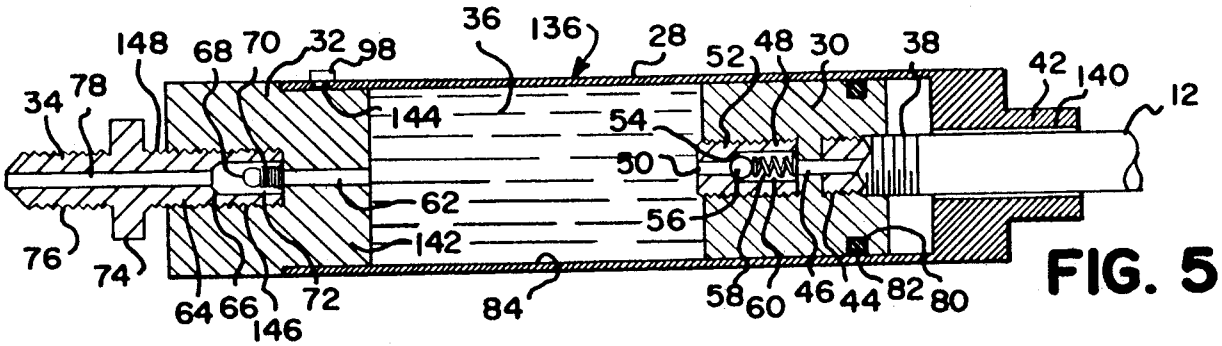
FIG. 5 is an enlarged, partial, cross sectional view taken along line 5—5 on FIG. 3, looking in the direction of the arrows.
Figure 6:
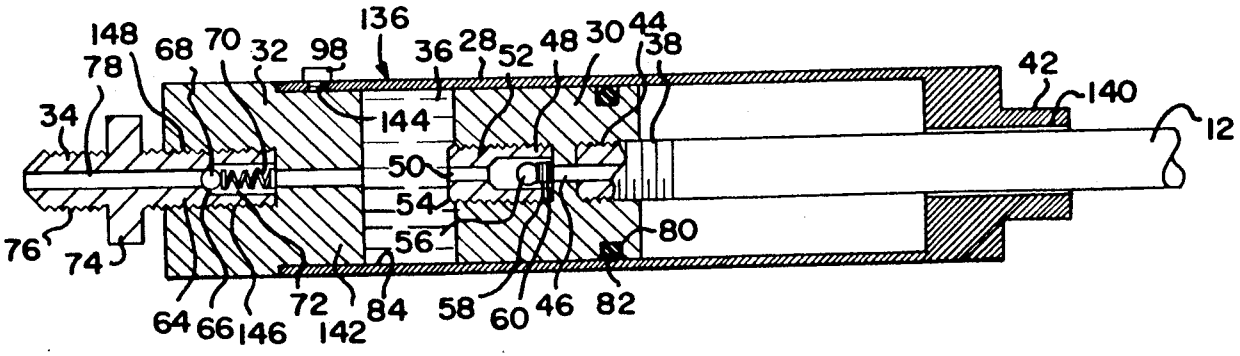
FIG. 6 is an enlarged, partial, cross sectional view taken along line 6—6 on FIG. 3, looking in the direction of the arrows.

Referring now to FIGS. 2, 5 and 6, the piston pump 136 comprises a hollow cylinder 28 which terminates forwardly in an integral hollow extension 42. As shown, the extension 42 is provided with an axially aligned interior channel 140 to reciprocally receive the rearward portion of the applicator tube 12 therethrough upon piston operation as hereinafter more fully set forth. The cylinder extension 42 inserts into the rearward end of the housing 14 and is tightly secured therein by the clamping bolt 126 which is positioned and tightened through the openings 106 which are provided in the pair of opposed rearward housing tabs or ears 104. Upon tightening the bolt 126 in conventional manner, the rear end of housing 14 will be clamped around the extension 42 of the cylinder 28 and the housing and cylinder will be tightly secured together at the cylinder connector 42.

As best seen in FIGS. 5 and 6, the rearward end of the cylinder 28 is closed by a plug 32 of plastic or other sufficiently tough, sturdy material. Plug 32 has an exterior portion and an interior portion 142. The interior portion 142 snuggly fits within the interior 36 of the cylinder 28. The cylinder wall is pierced and tapped adjacent the rearward end at opening 144 to provide for a set screw 98 that extends into the interior portion 142 of the plug to firmly affix the plug 32 to the cylinder 28 in a leak-proof interconnection.

Still referring to FIGS. 5 and 6, and further considering FIG. 2, the cylinder end plug 32 is axially provided with a threaded opening 146 to threadably receive therein the supply inlet fitting 34 to introduce the liquid to be sprayed into the interior 36 of the cylinder 28. The inlet fitting 34 comprises a body 74 with a polygonal central portion and cooperating exteriorly threaded portions 148 and 76. The threaded portion 148 extends forwardly of the central polygonal portion of the body 74, that portion being preferably hexagonally formed to facilitate turning the supply inlet fitting 34 into the threaded opening 146 in a secure, known, leak-proof interconnection. The threaded opening 146 communicates with an axially aligned end plug flow channel 62 to form a conduit to direct the liquid to be sprayed (not shown) into the cylinder interior 36. The rearwardly extending inlet threaded portion 76 of the inlet fitting 34 is used for connecting to a liquid supply hose (not shown) in the usual manner. An inlet flow channel 78 is drilled or otherwise provided axially through the inlet fitting 34, which channel communicates with the end cap flow channel 62 via a one-way valve such as a ball check valve assembly in the inlet fitting 34.

The ball check valve assembly 64 comprises a seat 66, a ball 68 and a coil spring 70. The coil spring 70 resides in the spring recess 72 and functions to continuously bias the ball 68 against its seat 66 in known manner to normally close the first valve 64.

When the operating spring 22 biases the piston 30 toward its suction position 88 upon release of the operating handle 16 as illustrated in FIGS. 4 and 5, the bias of the coil spring 70 will be overcome by the suction forces created by forward movement of the piston 30 relative to the cylinder 28, thereby allowing the ball check valve 64 to open to admit the liquid to be sprayed (not shown) into the interior 36 of the cylinder 28.

As illustrated in FIGS. 5 and 6 and as partly shown in FIG. 2, the piston 30 is reciprocal within the interior 36 of the cylinder 28 and comprises generally a circular, peripheral recess 80 within which is positioned a suitably sized 0-ring gasket 82 to prevent liquid leakage and thus pressure loss between the outer periphery of the piston 30 and the inner wall 36 of the cylinder 28 as the piston is reciprocated between its suction position 88 (FIGS. 4 and 5) and its applicating position 86 (FIGS. 3 and 6).

The piston 30 is drilled or otherwise formed to provide a flow channel 46 therethrough, usually axially, and a communicating internally threaded recess 44 which recess is threadedly engaged with the externally threaded end 38 of the applicator tube 12. Accordingly, the piston will be reciprocated within the interior of the cylinder 28 upon function of the operating handle 16 to reciprocate the applicator tube 12 relative to the cylinder 28. A threaded recess 60 is rearwardly provided in the piston 30 in fluid communication with the flow channel 46 and the threaded recess 44 and is tapped or otherwise worked to receive an externally threaded valve plug 48 therewithin. Preferably, the valve plug 48 is provided with a rearward slot 50 to facilitate assembly in well known manner and also to provide fluid communication from the cylinder 28 to the axial bores 46 and 60 of the piston 30. The valve plug 48 is provided with a second one-way valve or ball check valve assembly 52 comprising a recess 60, a ball seat 54, a ball 56 and a ball-biasing coil spring 58. The coil spring 58 biases between the rearward end of the recess 60 and the ball 56 to normally tend to close the second one-way valve assembly 52.

When the operating handle 16 is squeezed toward the housing 14 from the suction position 88 as illustrated in FIGS. 4 and 5 toward the applicating position 86 as shown in FIGS. 3 and 6, the applicator tube 12 will be rearwardly urged against the bias of the operating spring 22 to simultaneously move the piston 30 in the direction toward the rearward end plug 32. This rearward movement will cause the liquid chemical within the interior 36 of the cylinder 28 to be compressed, thus forcing liquid into recess 60, moving the second valve assembly ball 56 off of the second valve ball seat 54 by overcoming the bias of the spring 58. The second one-way valve 52 will thus be opened to allow the fluid (not shown) within the cylinder 28 to be forced through the recess 60, the flow channel 46 and thence through the hollow interior 150 of the applicator tube 12 for subsequent delivery directly upon the target area. The hydraulic forces functioning to open the second one-way valve 52 operate in exactly the opposite direction to close the first one-way valve 64 by forcing the first ball 68 more tightly against its seat 66 to thereby prevent the exit of any of the agricultural chemical or other liquid backwardly through the supply inlet fitting 34.

The adjustment collar 24 positions over the outer periphery of the applicator tube 12 and is secured forwardly of the volume control stop 26 by a suitable adjustment or set screw 96. By adjusting the position of the adjustment collar 26 upon the applicator tube 12 relative to the forward end 152 of the volume control stop 26, the length of travel of the applicator tube 12, and hence the length of travel of the piston 30 relative to the cylinder 28 can be closely and precisely controlled. By carefully regulating the length of travel of the piston 30 within the cylinder 28, the quantity of liquid chemical delivered through the applicator tube 12 can be closely controlled inasmuch as the quantity of liquid chemical applied is directly proportional to the length of travel of the piston 30 within the cylinder 28.

As best seen in FIGS. 1 and 2, a threaded fitting 132 threadedly engages the threaded end 40 of the applicator tube 12 to receive thereon a conventional spray nozzle 128. The spray nozzle 128 can be secured to the external threads 154 of fitting 132 by employing a suitable threaded nut 134 in well known manner. Preferably, a valve 130 is associated with the nozzle 128 to prevent leakage of any liquid agricultural chemical that may remain within the applicator tube 12 when the spot gun 10 is not in active use.

Although the invention has been described with a certain degree of particularity, it is understood that the present disclosure has been made only by way of example and that numerous changes in the details of construction and the combination and arrangement of parts may be resorted to without departing from the spirit and scope of the invention. Thus, the scope of the invention should not be limited by the foregoing specification, but rather, only by the scope of the claims appended hereto.

What is claimed is:

1. A volume controllable applicator for spraying a liquid upon a target area, comprising in straight-line elongated assembly:

an elongate application tube means to direct the liquid to the target area, the application tube means having a front, delivery end and a rear, coupleable end;

elongate housing means having first and second ends and being slidably secured adjacent the ends thereof about the applicator tube means intermediate the ends of the applicator tube means, the housing means having a slot-like opening extending along a side thereof and the applicator tube means being reciprocally movable relative to the housing means;

pump means comprising a cylinder, and piston means movable within the cylinder through a suction stroke and an application stroke, the piston means being attached to the applicator tube means and being directly reciprocal therewithin, the cylinder having first and second ends, the first end being attached to the second end of the housing means and being closed except for a gland through which the coupleable end of the applicator tube means extends, and the second end being closed apart from liquid inlet means;

one-way valve means associated with the liquid inlet means permitting liquid flow only into the cylinder;

the piston means having a borehole extending therethrough substantially in the axial direction, the borehole communicating with the applicator tube means and the interior of the cylinder, and a second one-way valve means within the borehole permitting liquid to flow only towards the applicator tube means;

operating handle means having a free end, and a pivotally attached end attached to the first end of the housing means, said first end facing the delivery end of the applicator tube means, and the operating handle being pivotal towards and away from the applicator tube means;

a collar surrounding and adjustably attached to the applicator tube means within and between the ends of the housing means and spaced apart from the pivotal attachment of the operating handle means;

a connection link member connecting and extending from the collar through the slot-like opening of the housing means to the operating handle at a point about midway between the ends of the operating handle, the connecting link being pivotally attached at each end thereof;

and spring means associated with the applicator tube means between the second end of the housing and the collar, biasing the collar away from the second end of the housing, the collar when in maximum biased position away from the second end of the housing holding the connecting link member at an angle of less then 90 degrees with respect to the applicator tube means in the direction of the pivotally attached end of the operating handle.

2. The apparatus of claim 1 wherein the second end of the cylinder is closed by a plug, the plug having an exterior face and a borehole extending through the plug substantially in the axial direction of the cylinder and having the liquid inlet means attached at the exterior face of the plug and communicating with the borehole therein, and the first one-way valve means being within said borehole.

3. A volume controllable applicator for applying a liquid upon a target area comprising an elongate applicator tube means to convey the liquid to the target area, the applicator tube means comprising a front delivery end and a rear, coupleable end;

housing means slidably secured about the applicator tube means intermediate its said ends, the housing means having a forward end and a rearward end, the applicator tube means being reciprocally movable relative to the housing means;

pump means comprising a cylinder having first and second ends and a piston means reciprocable within the cylinder, the piston means being attached to the rear, coupleable end of the applicator tube means, the first end of the cylinder being attached to the rearward end of the housing means, the piston means being reciprocable within the cylinder between a suction position and an applicating position, first one-way valve means to permit the suction of liquid only into the cylinder and second one-way valve means to permit the discharge of the liquid from the cylinder towards the applicator tube means in response to movement of the piston means to the said applicating position;

operating handle means having a free end and an attached end, the attached end being pivotally connected to the housing means and being movable between a suction position and an applicating position, the operating handle means being adapted to force the applicator tube means rearwardly relative to the housing means to move the piston means within the cylinder from its said suction position toward its said applicating position; and spring means associated with the applicator tube means and biasing between a part of the operating handle means and the first end of the cylinder to normally urge the piston means towards its said suction position;

whereby pivotal movement of the operating handle means relative to the housing means from its suction position toward its applicating position will cause the piston means to function the first and second valves to force the liquid through the applicator tube means for discharge upon the target area.

4. The volume controllable applicator of claim 3 wherein the operating handle means comprises an operating handle and a link pivotally interconnected between the operating handle and the applicator tube means, whereby pivotal movement of the operating handle will be transmitted directly to the applicator tube means to move the applicator tube means relative to the housing means.

5. The volume controllable applicator of claim 4 and an operating collar attached to the applicator tube means within the housing means and between the ends of the housing means, the spring means biasing between the cylinder and the said operating collar.

6. The volume controllable applicator of claim 5 and adjustment collar means secured to the applicator tube means forwardly of the housing means to contact the forward end of the housing means upon pivotal movement of the operating handle to limit the stroke of movement of the applicator tube means relative to the housing means.

7. The volume controllable applicator of claim 3 wherein the first and second one-way valves are ball valves, each said ball valve comprising a seat, a ball displaceable from the seat and a spring positioned to continuously bias the ball towards it seat.

8. The volume controllable applicator of claim 7 wherein the seat of the first one-way valve faces in the same direction as the seat of the second one-way valve.

9. The volume controllable applicator of claim 3 and means to prevent leakage of the applicator fluid intermediate the piston means and the cylinder means.

10. The volume controllable applicator of claim 3 wherein the liquid continuously fills the interior of the cylinder at all times as the piston means is reciprocated between its said applicating and suction positions.

11. The volume controllable applicator of claim 3 wherein a spray nozzle is affixed to the front end of the applicator tube means and wherein the spray nozzle is equipped with a third valve to prevent leakage of liquid through the nozzle when the applicator is not in use.

12. The volume controllable applicator of claim 3 and volume adjustment means secured to the housing means and to the applicator tube means to control the length of movement of the applicator tube means relative to the housing means.

13. The volume controllable applicator of claim 12 wherein the volume adjustment means comprises an adjustment collar means secured to the applicator tube means forwardly of the forward end of the housing means, the adjustment collar means being adjustably secured to permit easy relocating the adjustment collar means on the applicator tube means relative to the forward end of the housing means.

14. The volume controllable applicator of claim 13 wherein the volume adjustment means comprises a volume control stop secured to the housing means, the volume control stop being positioned to contact the adjustment collar means when the operating handle means is moved to its applicating position to limit the rearward movement of the applicator tube means relative to the housing means.

15. A volume controllable liquid applicator comprising a housing defining a hollow interior space and having a front and a rear;

an elongate applicator tube at least partially positioned within the housing interior space, the applicator tube being mounted to longitudinal reciprocate forwardly and rearwardly relative to the housing;

a piston pump secured to the rear of the housing, the piston pump comprising a stationary cylinder and a piston movable within the cylinder, the cylinder being connected to the rear of the housing and the piston being connected to the applicator tube, the piston being reciprocated within the cylinder when the applicator tube is reciprocated;

an operating handle pivotally connected to the housing and to the applicator tube, the operating handle being movable between a suction position and an applicating position to reciprocate the applicator tube relative to the housing;

first and second valves in the piston pump, the first and second valves each having an open position and a closed position, the first valve being open to admit liquid into the pump when the operating handle is moved to its said suction position, the second valve being open to admit liquid into the applicator tube when the handle is moved to its said applicating position; and a stop means adjustably secured to the applicator tube forwardly of the front of the housing in position to contact the housing front to limit the length of rearward movement of the applicator tube relative to the housing when the operating handle is moved to its said applicating position;

whereby the volumetric output of the piston pump can be precisely controlled by adjusting the position of the stop means upon the applicator tube.

16. The volume controllable applicator of claim 15 wherein the piston pump comprises a liquid inlet and a liquid outlet, the first valve being positioned in the liquid inlet and the second valve being positioned in the liquid outlet.

17. The volume controllable applicator of claim 16 wherein when the first valve is open, the second valve is closed.

18. The volume controllable applicator of claim 17 wherein when the second valve is open, the first valve is closed.

19. The volume controllable applicator of claim 15 and a spring biasing between the piston pump and the connection between the operating handle and the applicator tube, the spring continuously biasing the operating handle towards its said suction position.

20. The volume controllable applicator of claim 15 wherein the applicator tube comprises a front end and a spray nozzle means connected to the applicator tube front end, the spray nozzle means comprising a spray nozzle and a third valve to prevent liquid leakage from the applicator tube through the nozzle when the applicator is not in use.

* * * * *